United States Patent [19]

Martucci

[11] Patent Number: 5,066,242

[45] Date of Patent: Nov. 19, 1991

[54] ENVIRONMENT-PROOF ELECTRICAL CONNECTOR ASSEMBLY

[75] Inventor: Roberto Martucci, Montegrotto, Italy

[73] Assignee: Molex Incorporated, Lisle, Ill.

[21] Appl. No.: 597,469

[22] Filed: Oct. 15, 1990

[51] Int. Cl.[5] ..... H01R 13/40

[52] U.S. Cl. ..... 439/281; 439/587; 439/825

[58] Field of Search ..... 439/281, 282, 279, 278, 439/275, 587, 589, 603, 594, 592, 598, 752, 519, 825

[56] References Cited

U.S. PATENT DOCUMENTS 4,614,392 9/1986 Moore ..... 439/587

4,723,922 2/1988 Rush ..... 439/825

4,973,266 11/1990 Bullard ..... 439/281

*Primary Examiner*—Paula A. Bradley

*Attorney, Agent, or Firm*—Louis A. Hecht; Stephen Z. Weiss; A. A. Tirva

[57] ABSTRACT

An environment-proof electrical connector assembly includes first and second mateable connectors. The first connector has a male terminal. The second connector has a female terminal and includes a conductive receptacle defining a blind cavity for receiving the male terminal and for establishing an electrical connection with the male terminal within the blind cavity. A seal is provided on the first connector for closing the blind cavity in response to mating of the connectors to seal the electrical connection from the environment.

30 Claims, 5 Drawing Sheets

ENVIRONMENT-PROOF ELECTRICAL CONNECTOR ASSEMBLY

FIELD OF THE INVENTION

This invention generally relates to the art of electrical connectors and, particularly, to an electrical connector having an improved seal system for sealing the connector contacts from the environment.

BACKGROUND OF THE INVENTION

Electrical connectors often are used in environments which cause corrosion or other contamination which eventually will cause discontinuity between the electrical connections of the connector terminals of the connectors. Such connector assemblies should be sealed from the adverse environment to prevent such corrosion of the electrical connections. An example of an adverse environment is in automotive applications, such as under the hood of an automobile. Water, dirt, oil, grease and salt are but some of the contaminates which can migrate into electrical connectors to damage the electrical connections therewithin.

Most such environment-proof connectors use conventional gaskets, grommets or resilient plugs to seal the entrances of the electrical cables into the connectors. Similar seal means, along with O-rings, also might be used between the mating connector housings themselves to prevent migration of contaminates into the housings which would corrode the mating terminals therein.

However, there is a continuing problem with such sealing devices as described above because of corrosion of the resilient material itself which forms the seals. In addition, constant vibrations, such as in automotive applications, can eventually loosen the seal devices.

Corrosion of the electrical contact connections might be distinguished from corrosion of the electrical terminals themselves. In other words, a male or female terminal may corrode over long or severe use without diminishing the current carrying capability of the terminals. It is in the contact areas between the terminals where even a small amount of contamination can disrupt the current carrying capabilities between the terminals. This invention is directed to a new sealing system which not only seals the entrances of the electrical cables and seals the mating areas of the connector housings, but the precise terminal connections themselves are provided with additional sealing provisions.

SUMMARY OF THE INVENTION

An object, therefore, of the invention is to provide a new and improved environment-proof electrical connector assembly.

In the exemplary embodiment of the invention, the connector assembly includes a first or receptacle connector having at least one male terminal. A second or plug connector is mateable with the first connector and has a female terminal including conductive receptacle means defining a blind cavity for receiving the male terminal and for establishing an electrical connection with the male terminal within the cavity. Generally, seal means are provided on the first connector for closing the cavity in response to mating of the connectors to seal the electrical connection from the environment. Therefore, an internal seal is provided to isolate the actual electrical connection itself between the terminals of the mateable connectors.

As disclosed herein, the conductive receptacle means which defines the blind cavity of the female terminal in the second connector and the seal means on the first connector include telescoping sleeve portions sized and shaped to form a seal therebetween in response to mating of the connectors. More specifically, the preferred embodiment discloses that one of the sleeve portions is generally cylindrical and of a given diameter. The other of the sleeve portions is generally frusto-conical and has a narrow end smaller than the given diameter and a wider end larger than the given diameter. Therefore, the frusto-conical sleeve portion telescopes into the cylindrical sleeve portion and forms a seal therewith intermediate the ends of the frusto-conical sleeve portion.

In the exemplary embodiment of the invention, the female terminal comprises a stamped and formed metal member having a female end for positioning and holding the receptacle means which forms the blind cavity for receiving the male terminal. The receptacle means is formed as a deep drawn metal member. The male terminal is a stamped and formed metal member having a bifurcated end defining spring loaded arms for engaging the interior walls of the deep drawn metal member.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 1:
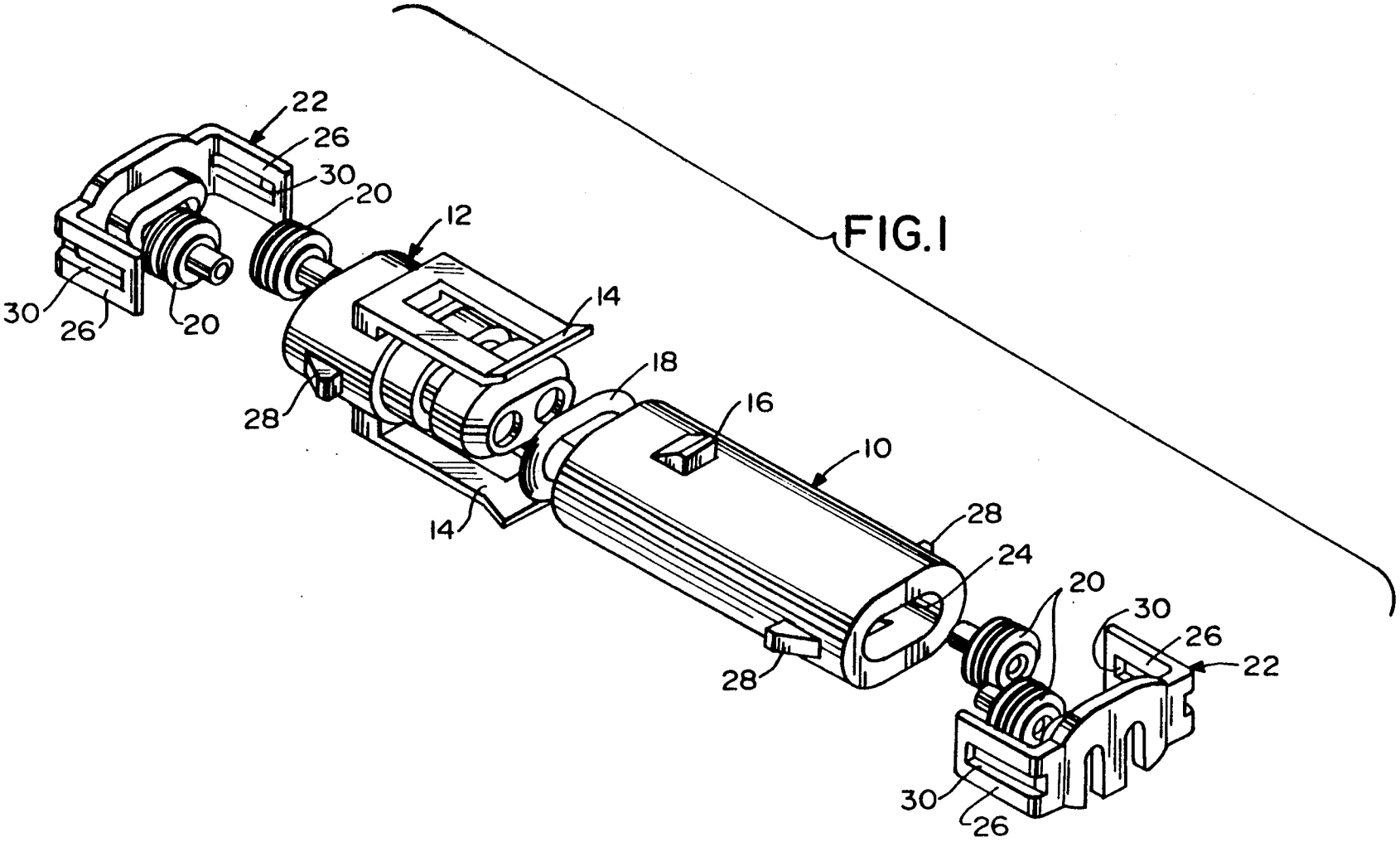
FIG. 1 is a perspective view of the plug and receptacle connector housings, and the sealing devices associated therewith, of the electrical connector assembly of the invention.

Referring to the drawings in greater detail, and first to FIG. 1, the environment-proof electrical connector of the invention includes a first or receptacle connector which includes a receptacle housing, generally designated 10, and a second or plug connector, including a plug housing, generally designated 12. Plug housing 12 is inserted into receptacle housing 10 to mate the connectors, and spring latch arms 14 on the plug housing snap behind latch ramps 16 on the top and the bottom of receptacle housing 10 to hold the connectors in mated condition. A sealing device 18, the precise position of which will be seen hereinafter, is disposed between the connector housings, when mated, to seal the interior of the housings from the environment. Although the housings technically are oblong in cross-section, seal device 18 is in the general form of an O-ring made of appropriate resilient sealing material.

Still referring to FIG. 1, the electrical connector assembly is designed for terminating a pair of electrical cables and, consequently, substantially identical sealing grommets or gaskets 20 are provided for surrounding the cables and sealing the entrances of the cables into the respective connector housings. Grommets 20 are fabricated of appropriate resilient sealing material. Again, the positional relationships of the sealing grommets will be seen better hereinafter. However, FIG. 1 shows a pair of "pusher" members, generally designated 22, for forcing the sealing grommets into sealing position within openings 24 at the back ends of the connector housings. As the sealing grommets are pushed to their sealing positions, latch arms 26 on the outside of the pusher members snap behind latch ramps or bosses 28 on the outside of the connector housings. Each latch arm 26 has an appropriately sized slot 30 into which latch bosses 28 snap to lock the pusher members to their respective connector housing and to hold sealing grommets 20 in their proper sealing positions within the housings. The connector housings and the pusher members are fabricated of appropriate dielectric material, such as plastic or the like.

Figure 2:
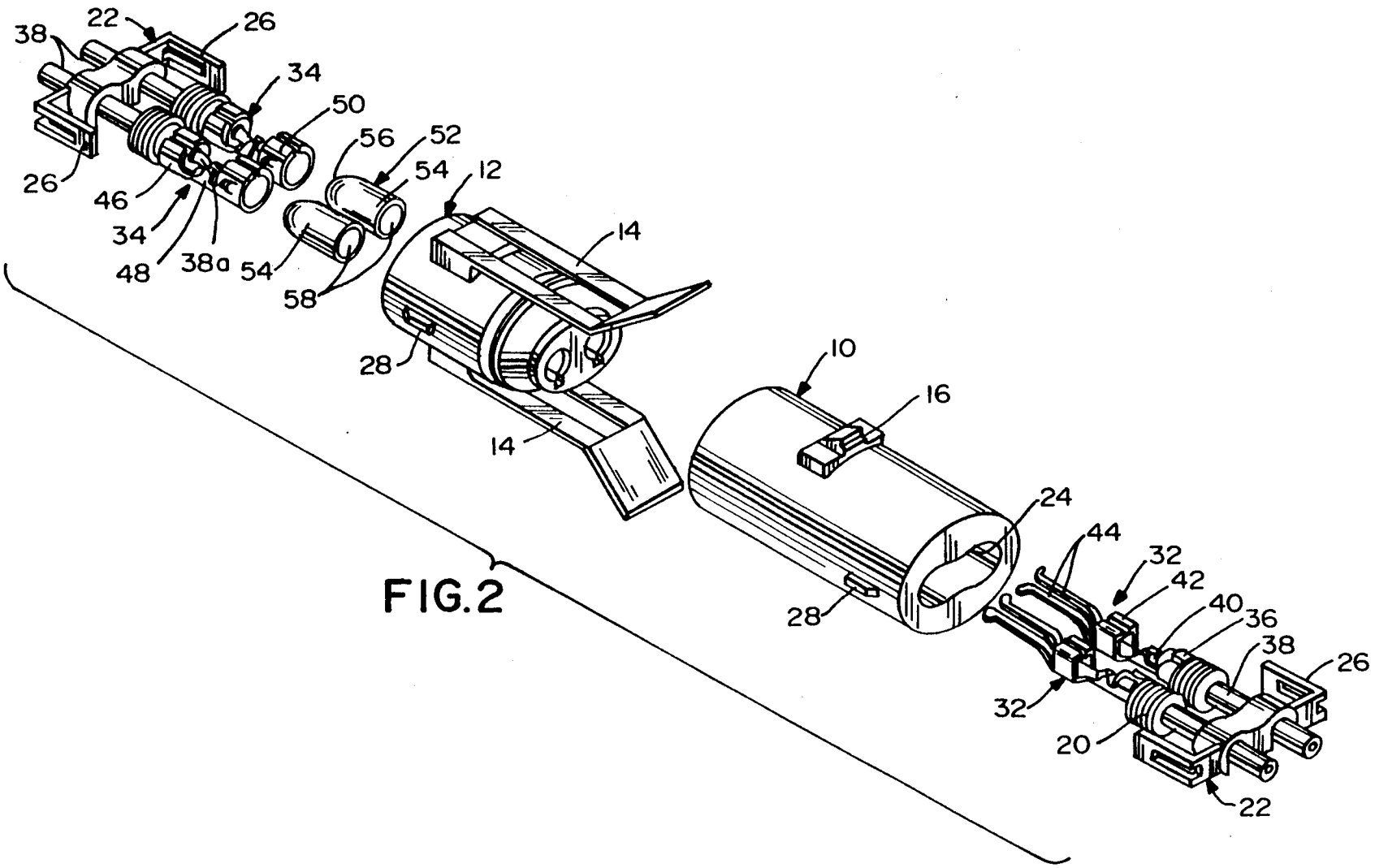
FIG. 2 is a perspective view similar to that of FIG. 1, but with the male and female terminals added to the depiction.

FIG. 2 shows the same components described above in relation to FIG. 1, but a pair of male terminals, generally designated 32, are shown in position for rear loading into receptacle connector housing 10, and a pair of female terminals, generally designated 34, are shown in position for rear loading into plug connector housing 12.

As will be shown in more detailed figures hereinafter, each male terminal 32 is a stamped and formed metal member which includes crimp arms 36 for crimping onto a respective electrical cable 38, crimp arms 42 for crimping onto the conductor(s) 38*a* of the cable, reinforcing arms 40 for providing rigidity to the terminal, and a bifurcated terminal end defining spring loaded terminal arms 44, as described hereinafter.

Each female terminal 34 includes crimp arms 46 for crimping onto a respective cable 38, crimp arms 48 for crimping onto the respective conductor 38*a* of the cable, and formed arms 50 to define a cylindrical terminal end of the female terminal. The invention contemplates the provision of receptacle means, generally designated 52, on each terminal end of each female terminal 34 for receiving and establishing an electrical connection with the terminal arms 44 of a respective male terminal 32. Each receptacle means 52 includes a cylindrical sleeve portion 54 and a closed end 56 defining a blind cavity 58 for receiving male terminal arms 44. One of the receptacle means 52 is positioned within the cylindrical terminal end of each of the female terminals 34, as described hereinafter.

Figure 3:
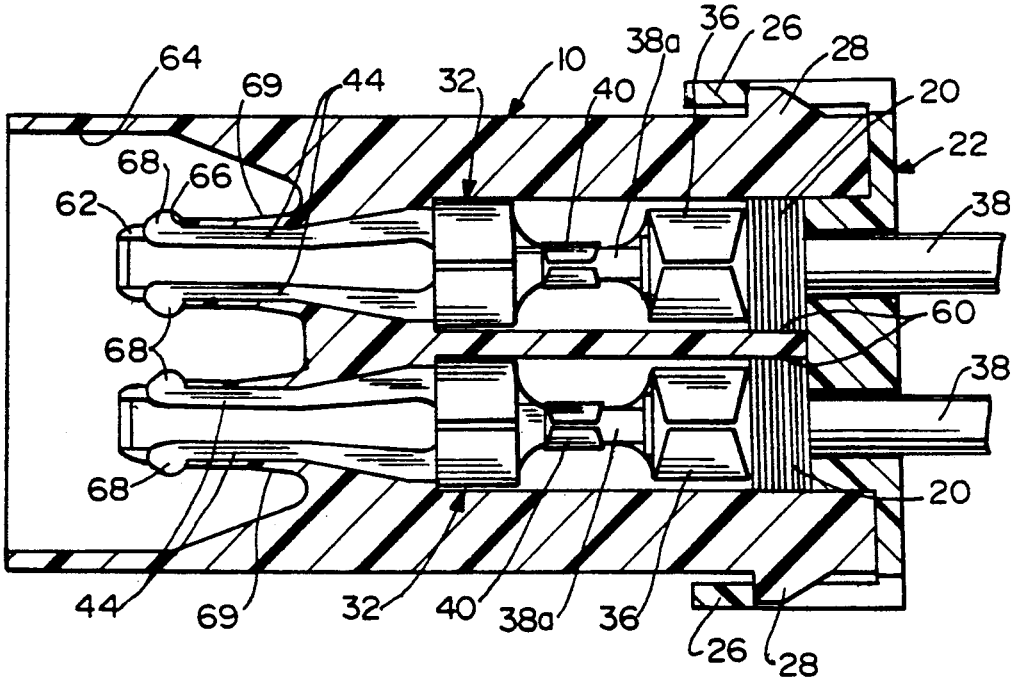
FIG. 3 is a longitudinal section through the receptacle housing with the male terminals positioned therewithin.

FIG. 3 shows plug connector housing 10 with male terminals 32 assembled therewithin, and with pusher member 22 having forced sealing grommets 20 into respective bores 60 behind the male terminals. Therefore, sealing grommets 20 seal the interior of receptacle housing 10 from the environment by sealing the rear of the terminal receiving bores. This figure more clearly shows crimp arms 36 crimping cable 38, crimp arms 40 crimping conductors 38*a* and terminal arms 44 projecting forwardly into the receptacle connector housing.

More particularly, receptacle connector housing includes a pair of integrally molded, forwardly projecting sleeves 62 interiorly of a receptacle cavity 64 which receives plug connector housing 12. Each sleeve 62 includes a pair of diametrically disposed side openings 66. Terminal arms 44 of male terminals 32 each have rounded, enlarged distal ends 68 which project outwardly through a respective opening 66 in the respective sleeve 62. Therefore, it can be seen that the terminal arms are exposed, by means of enlarged distal ends 68, on the outside of sleeves 62. These enlarged distal ends 68 establish the electrical connections with the female terminals of the plug connector as will be seen hereinafter. Terminal arms 44 are generally flat and coplanar in the mating direction of the connectors. It can be seen that each sleeve 62 has a frusto-conical outside surface portion 69, for purposes described hereinafter.

Figure 4:
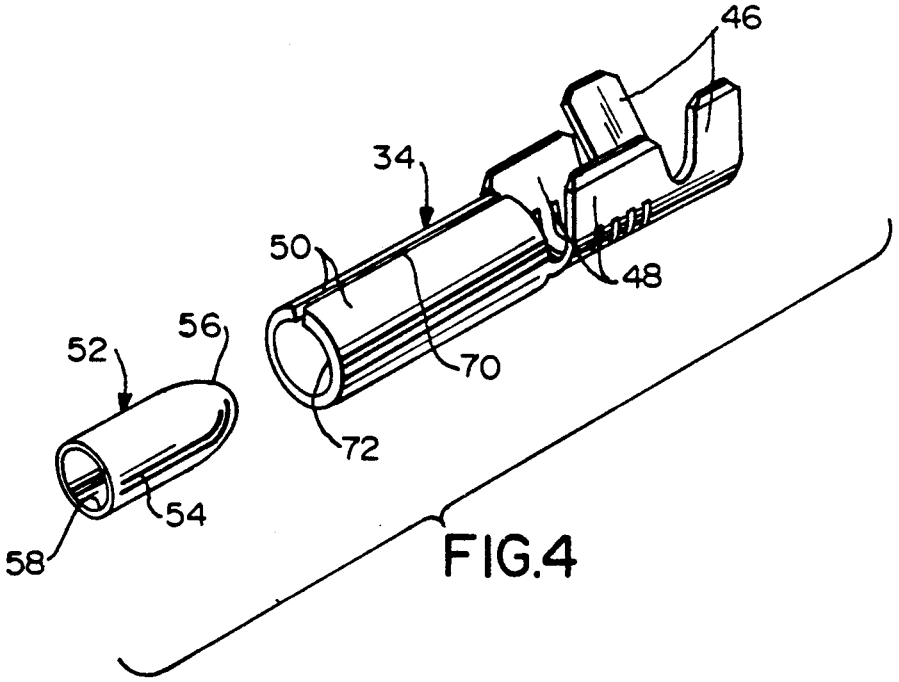
FIG. 4 is a perspective view of a female terminal and the receptacle means associated therewith forming a blind cavity for receiving the male terminal.

FIG. 4 shows an enlargement of one of the female terminals 34 in conjunction with one of the receptacle means 52. Specifically, the formed arms 50 which define the cylindrical terminal end of the female terminal are split, as at 70, and are formed by a rolling operation to define a cylindrical cavity 72. The closed end 56 of receptacle means 52 is inserted into cavity 72 whereby the inside of the female terminal for receiving terminal arms 44 of the male terminal 32 actually is defined by the interior blind cavity 58 of the cylindrical portion 54 of receptacle means 52.

Figure 5:
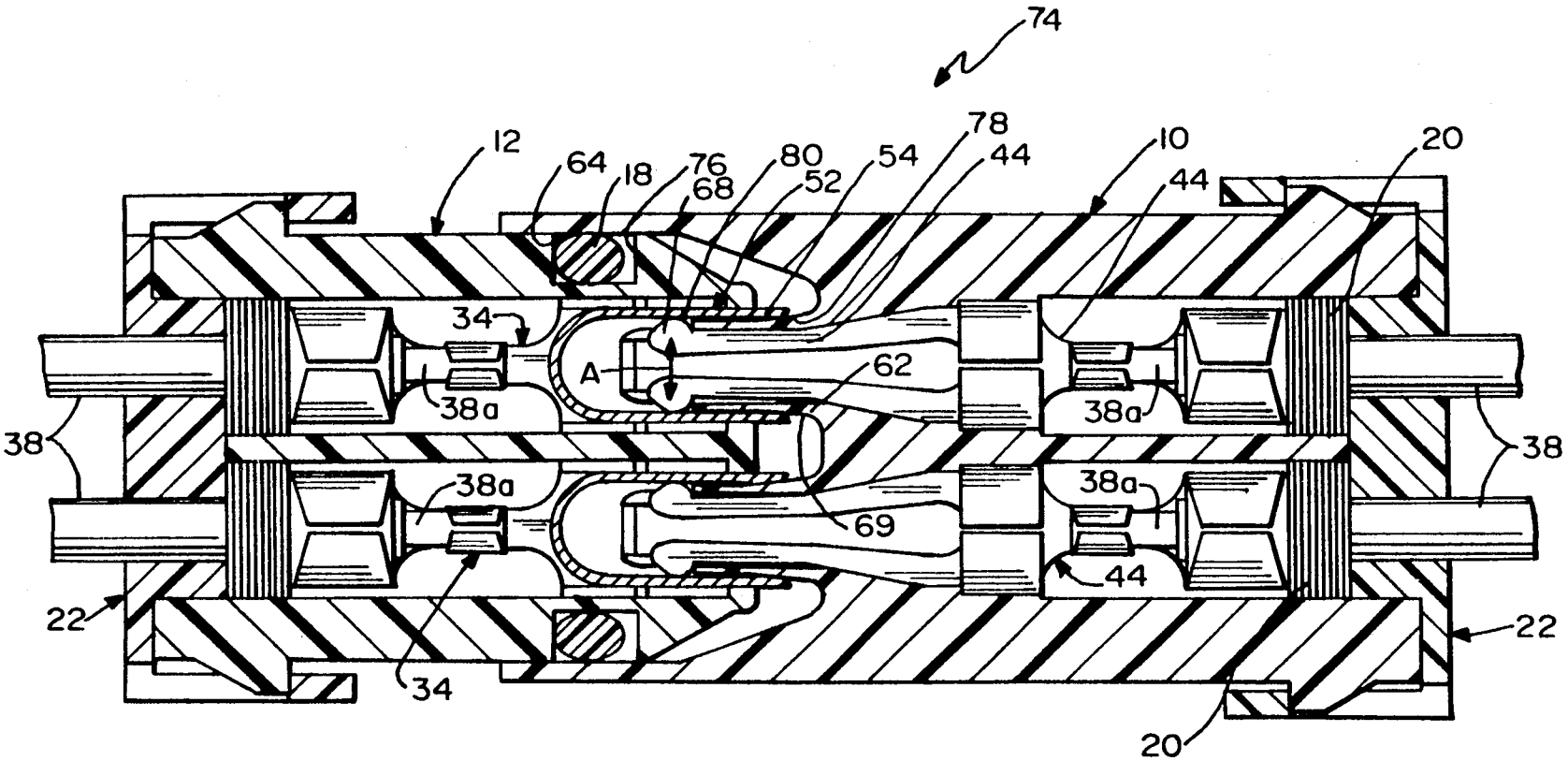
FIG. 5 is a longitudinal section of the plug and receptacle connectors in mated condition, and illustrating a first embodiment of the seal means of the invention.

FIG. 5 shows the entire environment-proof electrical connector assembly, generally designated 74, of the invention with receptacle connector housing 10 fully mated with plug receptacle housing 12. O-ring 18 is shown compressed within a peripheral groove 76 of the plug connector housing and engaging the interior of receptacle cavity 64 of the receptacle connector housing. This O-ring sealing device is provided for sealing the mating interior areas of the connectors. Again, it can be seen that sealing grommets 20 are in position for sealing the rear cable-entering areas of the connectors.

On the other hand, as described above, such sealing devices still can be affected by long or extensive use in adverse environments whereby the sealing devices can lose some of their sealing function. As also stated above, corrosion of portions of the terminals themselves may not completely destroy the current capabilities of the terminals. However, should contaminates reach the critical electrical connection points between the terminals, electrical continuity through the connector assembly can be lost or greatly diminished. To that end, it can be seen in FIG. 5 that the peripheral edge or mouth 78 of cylindrical sleeve portion 54 of each receptacle means 52 on each female terminal 34 is in engagement with the frusto-conical portion 68 of internal sleeve 62 on receptacle connector housing 10. Technically, cylindrical sleeve portion 54 has a given diameter. Frusto-conical surface 68 of sleeve portion 62 has a narrow end (the left-half end shown in the drawing) smaller than that given diameter and a wider end (the right-hand end in the drawing) larger than that given diameter. Therefore, sleeve 62 on the receptacle connector telescopes into sleeve 54 on the plug connector to form a tight seal intermediate the ends of the frusto-conical shape of surface 68 when the connectors are mated. This isolates the electrical connection areas 80 within the blind cavity of receptacle means 52 where the enlarged distal ends 68 of the male terminal arms 44 engage the inside of cylindrical sleeve portion 54 of the receptacle means.

With terminal arms 44 being stamped in a flat or coplanar configuration, the terminal arms are self-spring loaded and exert outward forces in the direction of double-headed arrow "A" (FIG. 5). These forces are substantially perpendicular to the mating direction of the connectors and, in conjunction with the rounded configuration of enlarged distal ends 68, provide for very low insertion forces, excellent electrical connection forces and afford a wide current range.

Figure 6:
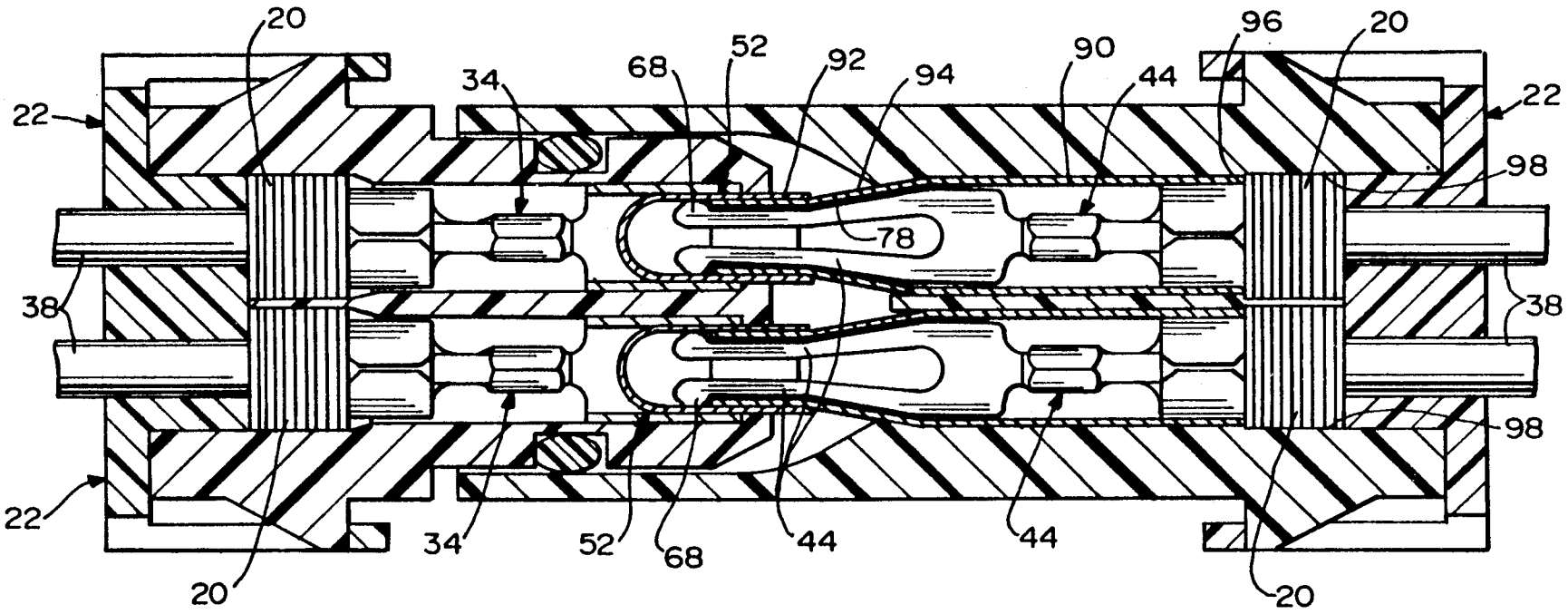
FIG. 6 is a longitudinal section similar to that of FIG. 5, illustrating an alternate form of seal means of the invention.

FIG. 6 shows an alternate form of the invention. The internal sleeves 62 surrounding male terminal arms 44, which define frusto-conical sealing surfaces 68, and which are formed integrally with receptacle connector housing 10, have been replaced by separate elongated sleeves 90 surrounding male terminals arms 44. Otherwise, like numerals have been applied to like components in FIG. 6 heretofore described in relation to FIGS. 1-5.

Each sleeve 90 is fabricated of dielectric material, such as plastic or the like, and has a forward end 92 of a smaller diameter than the sleeve portion of receptacle means 52 for telescoping thereinto when the connectors are mated. The sleeve also has a frusto-conical portion 94 for establishing tight sealing engagement with the mouth of receptacle means 52. In addition, each sleeve 90 extends rearwardly along the entire length of the respective male terminal 44, to completely surround the terminal, and to abut against the respective sealing grommet 20, as at 96. It should be understood that conventional sealing grommets, such as grommets 20 establish a seal in a sliding relationship, as at 98, with the interior of the respective bores. During long and extensive use, these sliding seals are prone to leakage. However, when pusher member 22 drives the sealing grommets forwardly, a tight compressive sealing interface is established at 96 between the forward surface of the sealing grommets and the rear circular surface of sleeve 90. It can be seen that by combining seal 78 about frusto-conical surface 94 in conjunction with abutment seal 96, each male terminal 44 is completely isolated within the connector.

From the foregoing, it will be understood that should O-ring seal 18 fail or should any of the sealing grommets 20 in either the receptacle connector or the plug connector fail, the male terminals still are completely isolated and sealed from the environment. This protects the vital electrical connection areas between the enlarged distal ends 68 of male terminal arms 44 and the interior surfaces of sleeve portion 54 of receptacle means 52 which defines the blind cavities for the male terminal arms.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An environment-proof electrical connector assembly comprising:

a first connector having a male terminal;

a second connector mateable with the first connector and having a female terminal including conductive receptacle means defining a blind cavity for receiving the male terminal and for establishing an electrical connection with the male terminal within the blind cavity;

seal means on the first connector for closing said cavity in response to mating of the connectors to seal said electrical connection from the environment; and wherein said receptacle means and said seal means include telescoping sleeve portions sized and shaped to form a seal therebetween in response to mating of the connectors.

2. The environment-proof electrical connector assembly of claim 1 wherein one of said sleeve portions is generally cylindrical and of a given diameter, and the other of the sleeve portions is generally frusto-conical having a narrow end smaller than the given diameter and a wider end larger than the given diameter whereby the other sleeve portion telescopes into the one sleeve portion and forms a seal therewith intermediate the ends of the frusto-conical shape.

3. The environment-proof electrical connector assembly of claim 1 wherein said receptacle means comprises a deep drawn metal member.

4. The environment-proof electrical connector assembly of claim 1 wherein one of said receptacle means and seal means is generally cylindrically shaped of a given diameter, and the other of the receptacle means and seal means is generally frusto-conical having a narrow end smaller than the given diameter and a wider end larger than the given diameter whereby the other of the receptacle means and seal means telescopes into the one of the receptacle means and seal means to form a seal therewith intermediate the ends of the frusto-conical shape.

5. The environment-proof electrical connector assembly of claim 1 wherein said receptacle means has an open mouth through which the male terminal is inserted into the cavity, and said seal means is structured to close the mouth on mating of the connectors.

6. The environment-proof electrical connector assembly of claim 5 wherein said seal means surrounds the male terminal.

7. The environment-proof electrical connector assembly of claim 1 wherein said female terminal comprises a stamped and formed metal member having a female end for positioning and holding said receptacle means.

8. The environment-proof electrical connector assembly of claim 7 wherein said receptacle means comprises a deep drawn metal member.

9. The environment-proof electrical connector assembly of claim 1 wherein said first connector includes a housing and said seal means is located within the housing.

10. The environment-proof electrical connector assembly of claim 9 wherein one of said receptacle means and seal means is generally cylindrically shaped of a given diameter, and the other of the receptacle means and seal means is generally frusto-conical having a narrow end smaller than the given diameter and a wider end larger than the given diameter whereby the other of the receptacle means and seal means telescopes into the one of the receptacle means and seal means to form a seal therewith intermediate the ends of the frusto-conical shape.

11. The environment-proof electrical connector assembly of claim 9 wherein said first connector includes a housing and said seal means comprises a member separate from the housing and surrounding the male terminal.

12. The environment-proof electrical connector assembly of claim 11 wherein one of said receptacle means and seal means is generally cylindrically shaped of a given diameter, and the other of the receptacle means and seal means is generally frusto-conical having a narrow end smaller than the given diameter and a wider end larger than the given diameter whereby the other of the receptacle means and seal means telescopes into the one of the receptacle means and seal means to form a seal therewith intermediate the ends of the frusto-conical shape.

13. The environment-proof electrical connector assembly of claim 1 wherein said male terminal includes spring loaded arms for engaging interior walls of the blind cavity.

14. The environment-proof electrical connector assembly of claim 13 wherein said male terminal comprises a stamped and formed metal member having a bifurcated end defining said spring loaded arms.

15. The environment-proof electrical connector assembly of claim 14 wherein said spring loaded arms are generally flat and coplanar in the mating direction of the connectors.

16. The environment-proof electrical connector assembly of claim 1, including a sealing device at a rear end of the male terminal, and wherein said seal means surrounds substantially the entirety of the male terminal and has a rear end for sealing against the sealing device.

17. The environment-proof electrical connector assembly of claim 16 wherein said first connector includes a housing and said seal means comprises a component separate from said housing for closing said cavity at a forward end and engaging the sealing device at a rearward end.

18. An environment-proof electrical connector assembly, comprising:

a first connector having a male terminal with spring loaded arms;

a sealing device at a rear end of the male terminal;

a second connector mateable with the first connector and having a female terminal with an open female end, and including conductive receptacle means positioned in the open female end of the female terminal defining a blind cavity for receiving the spring loaded arms of the male terminal and for establishing an electrical connection between the spring loaded arms and the interior of the receptacle means within the blind cavity; and seal means on the first connector for closing said cavity in response to mating of the connectors to seal said electrical connection from the environment wherein said seal means surrounds substantially the entirety of the male terminal and has a rear end for sealing against the sealing device.

19. An environment-proof electrical connector assembly of claim 18 wherein said receptacle means comprises a deep drawn metal member.

20. The environment-proof electrical connector assembly of claim 18 wherein said first connector includes a housing and said seal means comprises a component separate from said housing for closing said cavity at a forward end and engaging the sealing device at a rearward end.

21. The environment-proof electrical connector assembly of claim 18 wherein said first connector includes a housing and said seal means are located within the housing.

22. The environment-proof electrical connector assembly of claim 18 wherein said male terminal comprises a stamped and formed metal member having a bifurcated and defining said spring loaded arms.

23. The environment-proof electrical connector assembly of claim 22 wherein said spring loaded arms are generally flat and coplanar in the mating direction of the connectors.

24. The environment-proof electrical connector assembly, comprising:

a first connector having a housing and a male terminal;

a second connector mateable wit the first connector and having a female terminal including conductive receptacle means defining a blind cavity with an open mouth through which the male terminal is inserted into the cavity and for establishing an electrical connection between the male terminal and interior walls of the receptacle means within the cavity; and seal means on the first connector separate from the housing and surrounding the male terminal to close the mouth to the blind cavity in response to mating of the connectors to seal said electrical connection from the environment.

25. The environment-proof electrical connector assembly of claim 24, including a sealing device at a rear end of the male terminal, and wherein said seal means surrounds substantially he entirety of the male terminal and has a rear end for sealing against the sealing device.

26. The environment-proof electrical connector assembly of claim 25 wherein said first connector includes a housing and said seal means comprises a component separate from said housing for closing said cavity at a forward end and engaging the sealing device at a rearward end.

27. The environment-proof electrical connector assembly of claim 24 wherein said receptacle means and said seal means include telescoping sleeve portions sized and shaped to form a seal therebetween in response to mating of the connectors.

28. The environment-proof electrical connector assembly of claim 27 wherein one of said sleeve portions is generally cylindrical and of a given diameter, and the other of the sleeve portions is generally frusto-conical having a narrow end smaller than the given diameter and a wider end larger than the given diameter whereby the other sleeve portion telescopes into the one sleeve portion and forms a seal therewith intermediate the ends of the frusto-conical shape.

29. The environment-proof electrical connector assembly of claim 24 wherein said female terminal comprises a stamped and formed metal member having a female end for positioning and holding said receptacle means.

30. The environment-proof electrical connector assembly of claim 24 wherein said receptacle means comprises a deep drawn metal member.

* * * * *